US008702409B2

(12) United States Patent
Cavatorta et al.

(10) Patent No.: US 8,702,409 B2
(45) Date of Patent: Apr. 22, 2014

(54) SCREW COMPRESSOR HAVING MALE AND FEMALE ROTORS WITH PROFILES GENERATED BY ENVELOPING A RACK PROFILE

(75) Inventors: Paolo Cavatorta, Langhirano (IT); Umberto Tomei, Castenaso (IT)

(73) Assignee: Gardner Denver S.R.L., Milan (IT)

( * ) Notice: Subject to any disclaimer, the term of this patent is extended or adjusted under 35 U.S.C. 154(b) by 188 days.

(21) Appl. No.: 13/122,657

(22) PCT Filed: Mar. 31, 2010

(86) PCT No.: PCT/IB2010/051416
§ 371 (c)(1),
(2), (4) Date: Apr. 5, 2011

(87) PCT Pub. No.: WO2010/133981
PCT Pub. Date: Nov. 25, 2010

(65) Prior Publication Data

US 2011/0189044 A1 Aug. 4, 2011

(30) Foreign Application Priority Data

May 21, 2009 (IT) ..... PR2009A0042

(51) Int. Cl.
*F03C 2/00* (2006.01)
*F03C 4/00* (2006.01)
*F04C 2/00* (2006.01)

(52) U.S. Cl.
USPC ..... 418/201.3; 418/150; 418/201.1

(58) Field of Classification Search
USPC ..... 418/201.1, 201.3, 150, 206.1, 206.3, 418/206.5
See application file for complete search history.

(56) References Cited

U.S. PATENT DOCUMENTS

| | | | | |
|---|---|---|---|---|
| 3,314,598 | A * | 4/1967 | Lysholm | 418/201.3 |
| 4,643,654 | A | 2/1987 | Rinder | |
| 4,673,344 | A * | 6/1987 | Ingalls | 418/201.3 |
| 4,938,672 | A * | 7/1990 | Ingalls | 418/201.1 |
| 5,364,250 | A * | 11/1994 | Aoki et al. | 418/201.1 |
| 5,454,701 | A | 10/1995 | Chen | |
| 5,624,250 | A * | 4/1997 | Son | 418/201.3 |
| 6,296,461 | B1 | 10/2001 | Stosic | |
| 6,779,993 | B2 * | 8/2004 | Kim et al. | 418/201.3 |

FOREIGN PATENT DOCUMENTS

| | | |
|---|---|---|
| GB | 2 418 455 A | 3/2006 |
| WO | 97/43550 A1 | 11/1997 |

* cited by examiner

*Primary Examiner* — Theresa Trieu
(74) *Attorney, Agent, or Firm* — James B. Conte; Husch Blackwell LLP

(57) ABSTRACT

Screw compressor (1) comprising: a male (2) and a female rotor (3) rotating respectively around a first axis (01) and second axis (02) of rotation, said rotors (2;3) showing, in cross section, meshing lobes (4) and valleys (6) and having profiles generated by enveloping a rack profile (p) including a first curve (z1) of the rack profile (p) extending between a first point (H) and a second point (Q) in a Cartesian reference frame (X, Y) and having a convexity in the positive direction of the axis of abscissa (X), said first point (H) lying on the axis of abscissa (X) at a distance from an origin (0) of the Cartesian reference frame (X, Y) equal to an addendum (hi) of the male rotor (2).

11 Claims, 9 Drawing Sheets

SCREW COMPRESSOR HAVING MALE AND FEMALE ROTORS WITH PROFILES GENERATED BY ENVELOPING A RACK PROFILE

TECHNICAL FIELD AND BACKGROUND ART

The present invention relates to a screw compressor for air or gas, in particular for use in pressure applications (e.g. in the conveyance of granulates or powders, or in water treatment) and in vacuum applications (e.g. in gas, fume or steam exhaust systems).

As is well known, a screw compressor comprises at least one male rotor and at least one female rotor that mesh together during rotation around respective axes and are housed inside a casing body. Each of the two rotors has screw-shaped ribs that mesh with corresponding screw-shaped grooves of the other rotor. Both the male and female rotor show, in cross section, a predetermined number of lobes (or teeth) corresponding to their ribs and of valleys corresponding to their grooves. The number of lobes of the male rotor may be different from the number of lobes of the female rotor. Already in the 1970s, the symmetrical profiles of the lobes and valleys of rotors were replaced by asymmetrical profiles in order to improve the volumetric efficiency of the screw compressors.

As in all volumetric compressors, the volumetric efficiency of the screw compressor depends on the clearance between the two rotors and between the rotors and the body encasing them (formed by two cylinders connected together). Furthermore, the volumetric efficiency of the screw compressor is influenced by the opening present between the cusp of the casing body and the head of the two rotors when they start to mesh. Through the opening, the gas contained between the valleys of the rotors is placed in communication with the intake area of the compressor; hence the gas flows back toward the latter and the volumetric efficiency declines. In cross section, corresponding to this opening there is a blow hole area having the shape of a triangle with curvilinear sides formed by the tip portions of the lobes of the two rotors. The blow hole area must be minimised by means of an accurate design of the profiles of the rotors such as to maximise the volumetric efficiency.

Starting from the definition of the profile of one of the two rotors (e.g. the female rotor) and applying the principle of "conjugate profiles", drawn from the theory of meshing and gearings, it is possible to obtain the profile of the other rotor (in this case the male rotor). It should be noted, for the sake of completeness, that the two profiles are conjugate if and only if one profile envelops the various positions that the other profile assumes in the relative motion defined by the two polars (in the specific case of rotors, the polars are circumferences). The application of the principle of conjugate profiles to generate the rotors of a screw compressor is described, for example, in document U.S. Pat. No. 5,454,701.

Another possibility for generating the profiles of two rotors involves the use of the same generating rack, as is shown, for example, in documents WO97/43550, U.S. Pat. No. 4,643,654 and GB2418455. By rolling, without sliding, the polar of the profile of the generating rack respectively on the polar of the male rotor and on the polar of the female rotor, the profiles of the two rotors are determined as the envelope of the positions assumed by the rack profile itself.

One the problems to be confronted when designing the profiles of screw compressor rotors regards the definition of their profiles by means of cutting tools, which tend to wear easily. In particular, the construction of the female rotor is particularly critical, since the reduced thickness of its lobes limits the stresses allowable during cutting of the lobes themselves.

In this context, the technical task at the basis of the present invention is to propose a screw compressor which overcomes the limitations of the above-mentioned prior art.

DISCLOSURE OF THE INVENTION

In particular, it is an object of the present invention to provide a screw compressor that is easy and economical to construct using easy-to-manufacture cutting tools in which wear is reduced compared to prior art solutions.

Another object of the present invention is to propose a screw compressor that allows optimising the volumetric efficiency, i.e. maximising the volume conveyed in a complete rotation of the two rotors.

The defined technical task and the specified objects hereof are substantially achieved by a screw compressor comprising the technical characteristics described in one or more of the appended claims.

BRIEF DESCRIPTION OF DRAWINGS

Further characteristics and advantages of the present invention will become more apparent from the following approximate, and hence non-restrictive, description of a preferred, but not exclusive, embodiment of a screw compressor as illustrated in the appended drawings, in which.

BEST MODE FOR CARRYING OUT THE INVENTION

Figure 1:
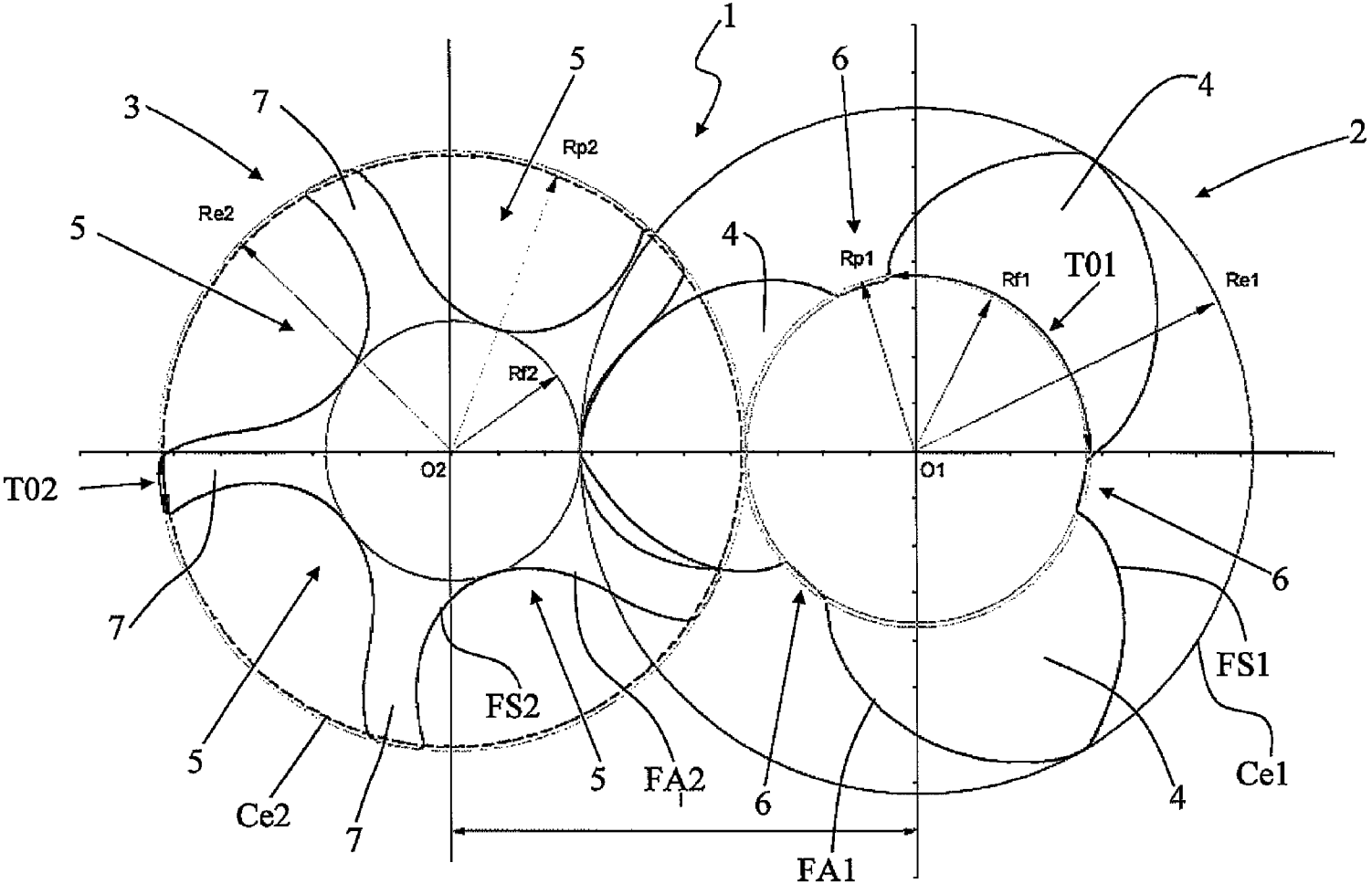
FIG. 1 illustrates a cross section of a screw compressor according to the present invention.

With reference to the figures, 1 indicates a screw compressor comprising at least one male rotor 2 and at least one female rotor 3, conjugate to each other. In the embodiment described and illustrated herein, there is present a single male rotor 2 and a single female rotor 3 housed inside a casing body 8 (partially illustrated in FIG. 7). In particular, said casing body 8 is obtained by joining together two cylinders which mutually communicate so as to form a single housing cavity for the rotors 2, 3. In an alternative embodiment (not illustrated), there are provided a plurality of conjugate pairs of male rotors 2 and female rotors 3. As illustrated in FIG. 1, the male rotor 2 rotates around a first axis O1 of rotation, whereas the female rotor 3 rotates around a second axis O2 of rotation. In particular, the first axis O1 is located at a distance I (commonly known by the term "centre distance") from the second axis O2 of rotation. The first axis O1 and second axis O2 are mutually parallel. Each of said rotors 2, 3 has screw-shaped ribs which mesh with screw-shaped grooves formed between the corresponding screw-shaped ribs of the other rotor 2, 3. Accordingly, in cross section, the male rotor 2 shows lobes 4 (or teeth) and valleys meshing with corresponding valleys 5 and lobes 7 (or teeth) of the female rotor 3.

Figure 2:
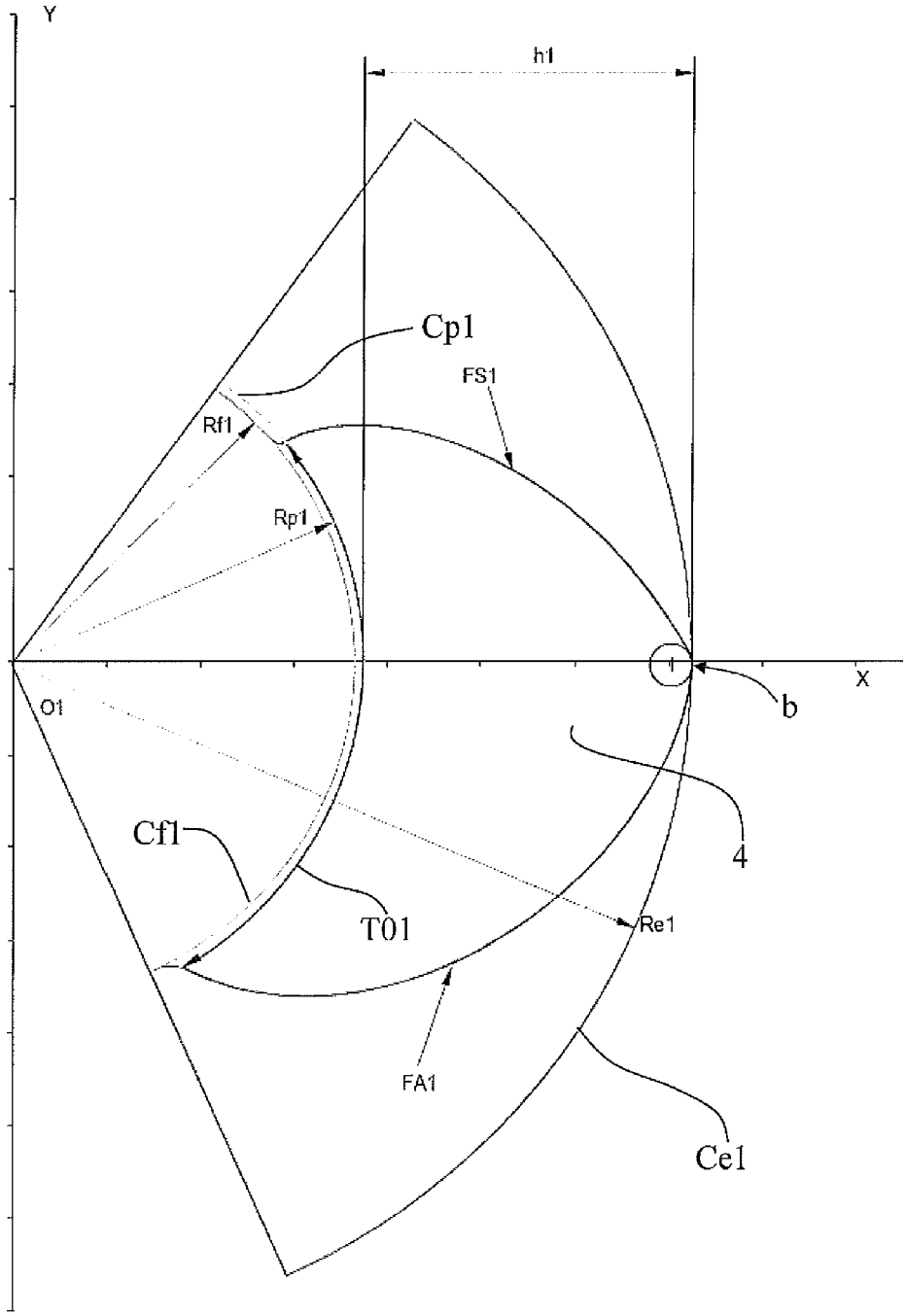
FIG. 2 illustrates a cross section of a portion (lobe of the male rotor) of the screw compressor of FIG. 1.

FIG. 2 illustrates the significant parameters which characterise the male rotor 2. In particular, there is identified a pitch circumference Cp1 of the male rotor 2, also corresponding to the polar of the male rotor 2. The measure of the radius Rp1 of the pitch circumference Cp1 of the male rotor 2 is proportional to the number of lobes 4 of the male rotor 2. Each lobe 4 of the male rotor 2 extends prevalently outside the corresponding pitch circumference Cp1 until reaching an outer circumference Ce1 of the male rotor 2. The remaining part of the lobe 4 of the male rotor 2 extends inside the corresponding pitch circumference Cp1 until reaching a root circumference Cf1 of the male rotor 2. The radius Rf1 of the root circumference Cf1 is smaller than the radius Rp1 of the pitch circumference Cp1, which is in turn smaller than the radius Re1 of the outer circumference Ce1 of the male rotor 2.

The distance between the pitch circumference Cp1 and the outer circumference Ce1 of the male rotor 2 is defined as the addendum h1 of the male rotor 2. Said addendum h1 of the male rotor 2 corresponds to the difference between the value of the radius Re1 of the outer circumference Ce1 and the value of the radius Rp1 of the pitch circumference Cp1 of the male rotor 2.

Figure 3:
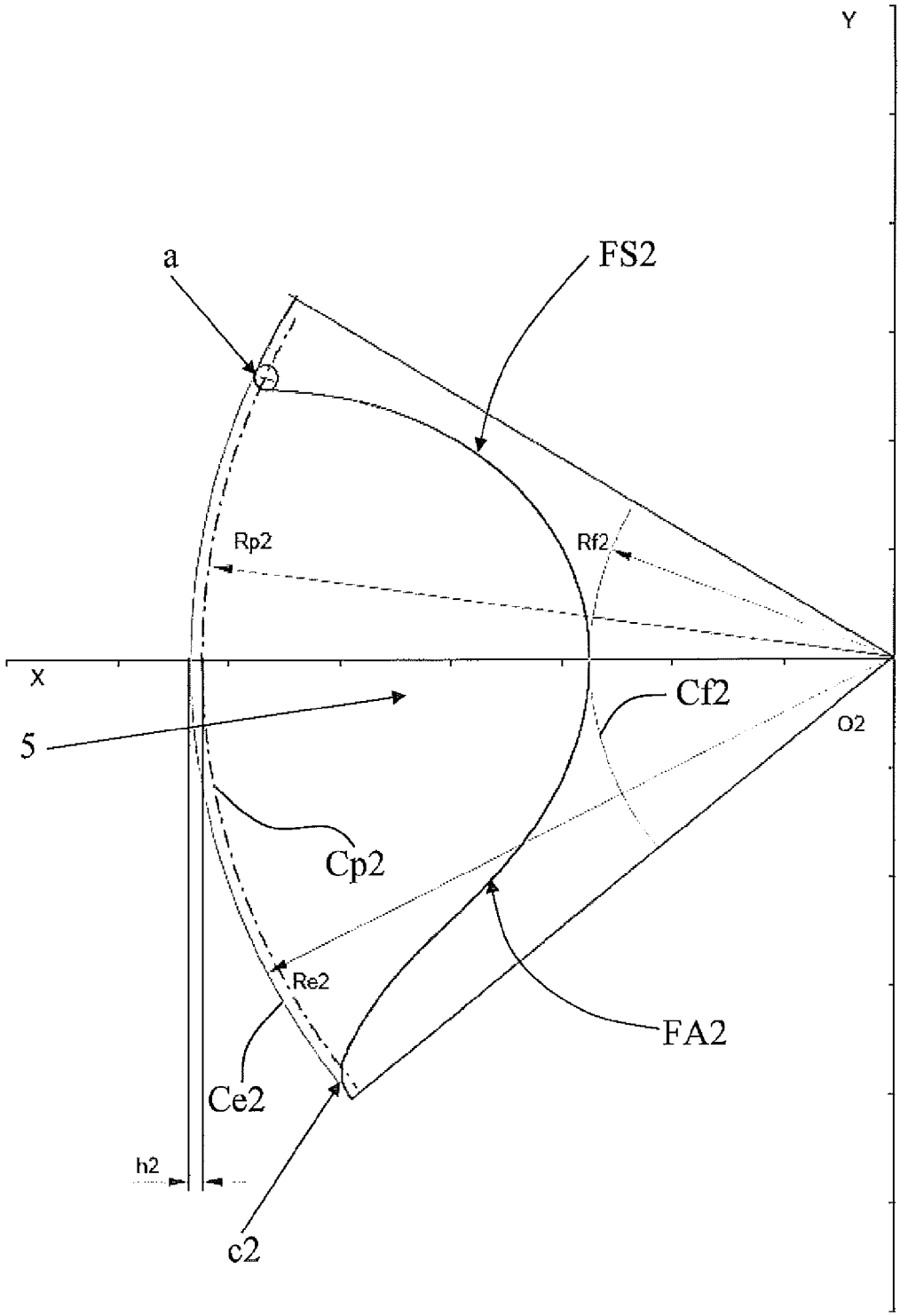
FIG. 3 illustrates a cross section of a different portion (valley of the female rotor) of the screw compressor of FIG. 1.

FIG. 3 illustrates the significant parameters which characterise the female rotor 3. In particular, there is identified a pitch circumference Cp2 of the female rotor 3, also corresponding to the polar of the female rotor 3. The measure of the radius Rp2 of the circumference Cp2 of the female rotor 3 is proportional to the number of lobes 7 of the female rotor 3. Preferably, the number of lobes 7 of the female rotor 3 is different from the number of lobes 4 of the male rotor 2. In the embodiment described and illustrated herein, the number of lobes 4 of the male rotor 2 is equal to three, whereas the number of lobes 7 of the female rotor 3 is equal to 5. Each valley 5 of the female rotor 3 extends prevalently inside the corresponding pitch circumference Cp2 until reaching a root circumference Cf2 of the female rotor 3. The remaining part of the valley 5 of the female rotor 3 extends outside the corresponding pitch circumference Cp2 until reaching an outer circumference Ce2 of the female rotor 3. The radius Rf2 of the root circumference Cf2 is smaller than the radius Rp2 of the pitch circumference Cp2, which is in turn smaller than the radius Re2 of the outer circumference Ce2 of the female rotor 3.

The distance between the pitch circumference Cp2 and the outer circumference Ce2 of the female rotor 3 is defined as the addendum h2 of the female rotor 3. Said addendum h2 of the female rotor 3 corresponds to the difference between the value of the radius Re2 of the outer circumference Ce2 and the value of the radius Rp2 of the pitch circumference Cp2 of the female rotor 3.

As can be seen in FIG. 1, each lobe 4 of the male rotor 2 has a first thickness T01 measured on the respective pitch circumference Cp1, whereas each lobe 7 of the female rotor 3 has a second thickness T02 measured on the respective pitch circumference Cp2.

Each valley 5 of the female rotor 3 has at least a side FS2 joined with the consecutive lobe 7 of the female rotor 3 (i.e. with the outer circumference Ce2 of the female rotor 3) by means of a first arc 'a' having a radius of a predefined length RT2. Preferably, the length RT2 of the radius of the first arc 'a' varies between a minimum value equal to the addendum h2 of the female rotor 3 multiplied by 1.1, and a maximum value equal to the addendum h2 of the female rotor 3 multiplied by 1.5.

As can be seen from FIG. 3, each valley 5 of the female rotor 3 has two sides FA2, FS2 of different extent conjugated with two respective sides FA1, FS1 (likewise of different extent) of the lobe 4 of the male rotor 2. In the embodiment described and illustrated here, the side FA1 of greater extent of the lobe 4 of the male rotor 2 is the one that leads in the direction of rotation of said male rotor 2, whereas the side of smaller extent FS1 of the lobe 4 of the male rotor 2 is the one that trails in the direction of rotation of the male rotor 2 itself. The side FA2 of greater extent of the valley 5 of the female rotor 3 is the one that leads in the direction of rotation of said female rotor 3, whereas the side FS2 of smaller extent of the valley 5 of the female rotor 3 is the one that trails in the direction of rotation of the female rotor 3 itself. Preferably, the two sides FA1, FS1 of each lobe 4 of the male rotor 2 are joined by a second arc b having a predefined length RT1. Preferably, the length RT1 of the radius of the second arc b varies between a minimum value equal to double the predefined length RT2 of the radius of said first arc 'a' and a maximum value equal to the predefined length RT2 of the radius of said first arc 'a' multiplied by 2.5.

As illustrated in FIG. 3, said first arc 'a' joins the side FS2 of smaller extent of each valley 5 of the female rotor 3 with the consecutive lobe 7 of the female rotor 3. The side FA2 of greater extent of the valley 5 of the female rotor 3 is joined with the consecutive lobe 7 of the female rotor 3 (i.e. with the outer circumference Ce2 of the female rotor 3) by a joining curve c2.

The lobes 4 of the male rotor 2 and the valleys 5 of the female rotor 3 have profiles generated, at least partially, by enveloping a rack profile p identified in a Cartesian reference frame (X, Y) and having a polar coinciding with the axis of ordinates Y. In this context the wording "at least partially" is intended to indicate that the profile portions of the lobes 4 of the male rotor 2 extending outside the respective pitch circumference Cp1 and the profile portions of the valleys 5 of the female rotor 3 extending inside the respective pitch circumference Cp2 are generated by enveloping said rack profile p. Preferably, the lobes 4 of the male rotor 2 and the valleys 5 of the female rotor 3 have profiles generated entirely by enveloping said rack profile p. This means that even the profile portions of the lobes 4 of the male rotor 2 extending inside the respective pitch circumference Cp1 and the profile portions of the valleys 5 of the female rotor 3 extending outside the respective pitch circumference Cp2 are generated by enveloping said rack profile p.

The profile of the male rotor 2 is generated by enveloping the positions assumed by the rack profile p when the polar (i.e. the axis of ordinates Y) of the rack profile p rolls without sliding on the polar (i.e. on the pitch circumference Cp1) of the male rotor 2. The profile of the female rotor 3 is generated by enveloping the positions assumed by the rack profile p when the polar (i.e. the axis of ordinates Y) of the rack profile p rolls without sliding on the polar (i.e. on the pitch circumference Cp2) of the female rotor 3.

In particular, the profiles of the lobes 4 of the male rotor 2 and of the valleys 5 of the female rotor 3 have portions generated by enveloping a first curve z1 of the rack profile p (see FIGS. 4*a*, 4*b*, 5*a* and 5*b*). Said first curve z1 extends, in the Cartesian reference frame (X, Y), between a first point H and a second point Q. Said first point H lies on the axis of abscissa X at a distance from an origin O of the Cartesian reference frame (X, Y) equal to the addendum h1 of the male rotor 2. Advantageously, said first curve z1 has a convexity in the positive direction of the axis of abscissa X. Preferably, said first curve z1 is a branch of hyperbola in which a generic point S has coordinates (XS, YS) defined by the following equations:

$$XS=(h1+RA)-RA/\cos\Phi$$

$$YS=-HB\ tg\ \Phi.$$

Figure 6:
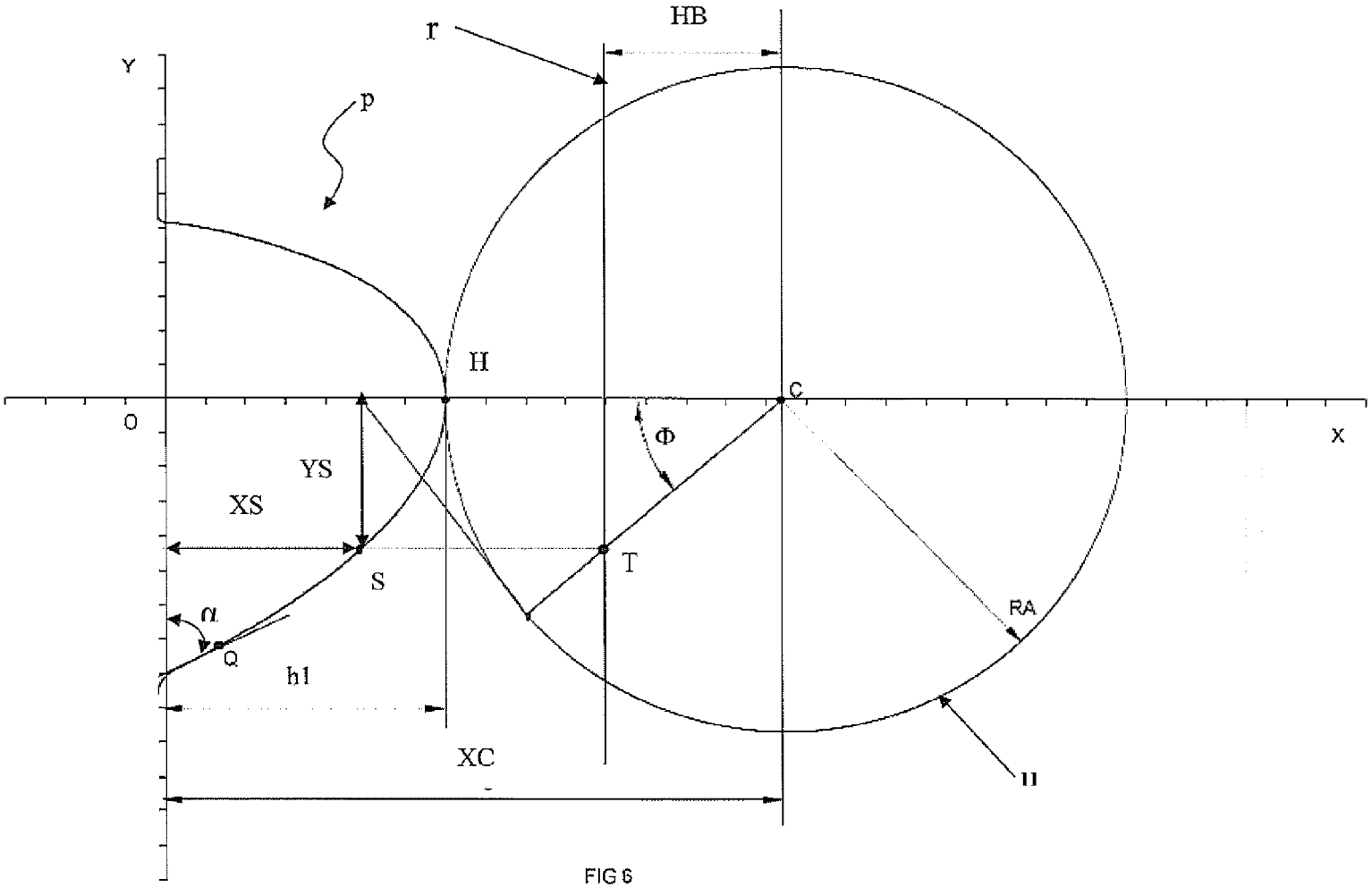
FIG. 6 illustrates a portion (first curve) of the rack profile of FIGS. 4 and 5 and the method of construction thereof.

Said equations are parametric, i.e. expressed as a function of a first parameter RA, a second parameter HB and a third parameter Φ. Advantageously, said first curve z1 is constructed from an auxiliary circumference u and an auxiliary line r, as shown in FIG. 6. In particular, the auxiliary circumference u has a centre C lying on the axis of abscissa X and is tangent to the rack profile p in said first point H. The auxiliary line r is parallel to the axis of ordinates Y and intersects the axis of abscissa X between said first point H and the centre C of the auxiliary circumference u. The first parameter RA represents the measure of a radius of the auxiliary circumference u. Therefore, the centre C of the auxiliary circumference u is located at a distance from the origin O of the Cartesian reference frame (X, Y) which is equal to the sum of the addendum h1 of the male rotor 2 and the measure RA of the radius of the auxiliary circumference u. Preferably, the first parameter RA varies between a minimum value equal to the centre distance I and a maximum value equal to fifty times the centre distance I.

The second parameter HB represents the distance of the auxiliary line r from the centre C of the auxiliary circumference u.

Let T indicate an auxiliary point lying on the auxiliary line r and having an ordinate YT equal to the ordinate YS of the generic point S of the branch of hyperbola. The third parameter Φ indicates an auxiliary acute angle delimited by the axis of abscissa X and by a radius of the auxiliary circumference u passing through the auxiliary point T. In particular, the third parameter Φ varies within the interval between 0° and 90°.

Figure 4A:
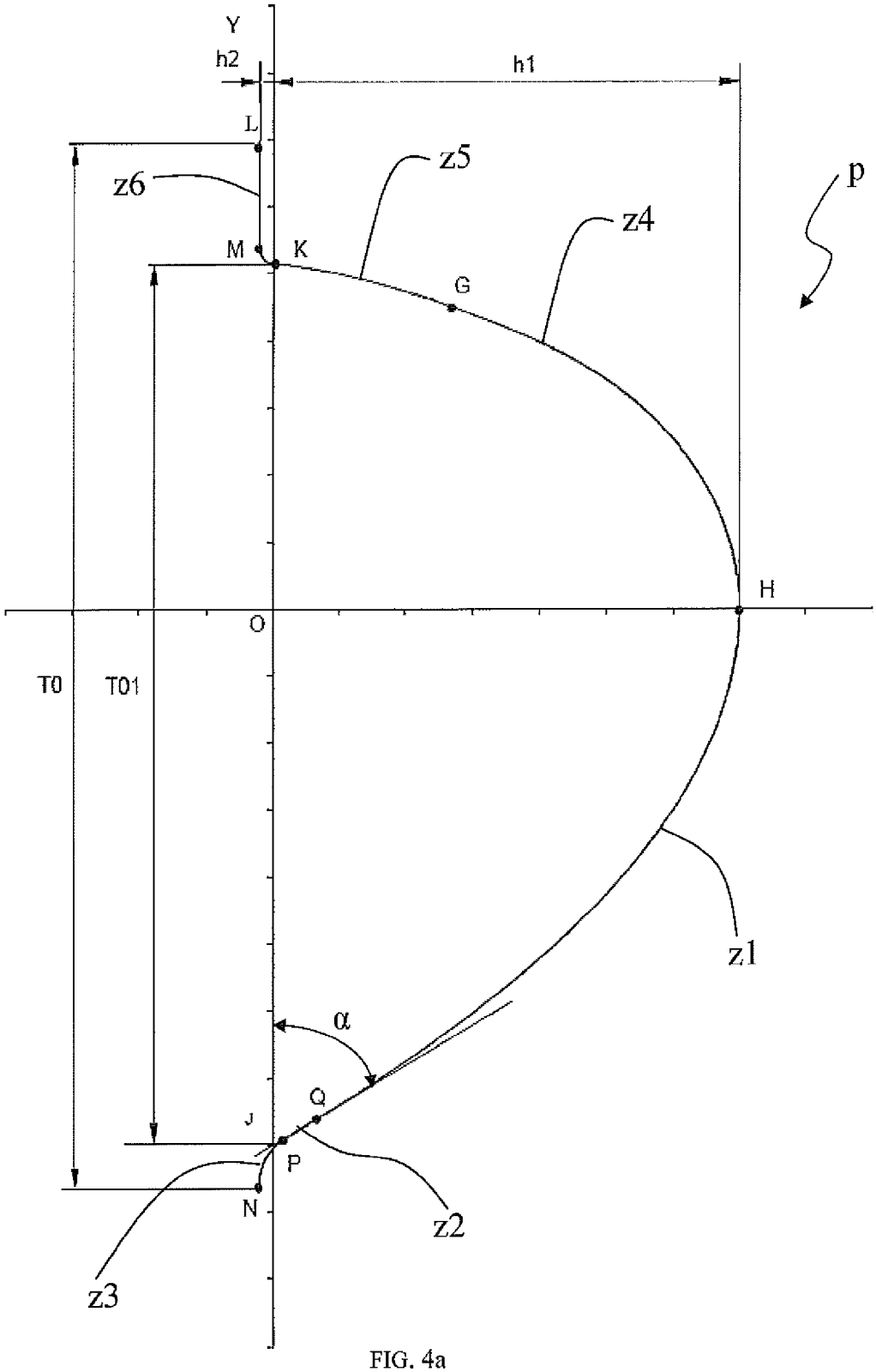
FIG. 4*a* illustrates the graph of a first embodiment of a rack profile used to construct the compressor of FIG. 1.
Figure 4B:
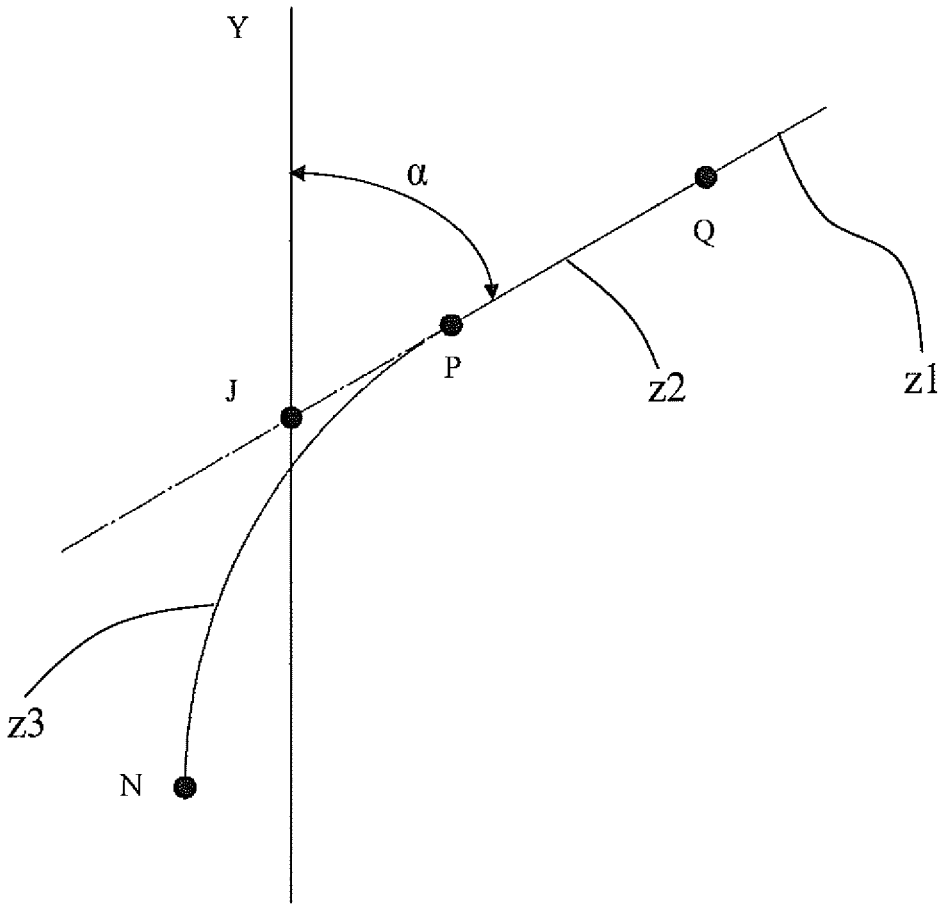
FIG. 4*b* illustrates an enlarged view of a portion of the rack profile of FIG. 4*a;*

In a first embodiment, illustrated in FIG. 4*a*, the rack profile p comprises, in addition to the first curve z1, a second curve z2, a third curve z3, a fourth curve z4, a fifth curve z5 and a sixth curve z6.

The second curve z2 of the rack profile p consists of a rectilinear segment extending between the second point Q and a third point P. In particular, said second curve z2 is tangent to the first curve z1 in the second point Q. The extension of the second curve z2 (i.e. of the rectilinear segment) intersects the axis of ordinates Y in a fourth point J (see FIG. 4*b*) in such a way as to form a main acute angle α with the axis of ordinates Y. Preferably, said main acute angle α has a value between 10° and 50°.

The third curve z3 of the rack profile p consists of an arc extending between said third point P and a fifth point N. In particular, said third curve z3 is tangent to the second curve z2 in the third point P. The measure of the radius of the third curve z3 is such that the tangent to said third curve z3 in the fifth point N is parallel to the axis of ordinates Y.

The fourth curve z4 of the rack profile p consists of a trochoid extending between said first point H and a sixth point G. In particular, said fourth curve z4 is tangent to the first curve z1 in the first point H. By enveloping the male rotor 2, the fourth curve z4 generates the second arc b joining the sides FA1, FS1 of the male rotor 2.

The fifth curve z5 of the rack profile p extends between said sixth point G and a seventh point M having a distance from the axis of ordinates Y equal to an addendum h2 of the female rotor 3. In particular, said fifth curve z5 is tangent to the fourth curve z4 in the sixth point G. By enveloping the female rotor 3, said fifth curve z5 generates said first arc 'a'.

The sixth curve z6 of the rack profile p consists of a rectilinear segment parallel to the axis of ordinates Y and extending between said seventh point M and an eighth point L. In particular, the distance between said eighth point L and the fifth point N is equal to the sum of the first thickness T01 of the lobe 4 of the male rotor 2 and the second thickness T02 of the lobe 7 of the female rotor 3 (the sum is indicated with T0 in FIG. 4*a*). The six curves described above define a composite curve, which, replicated infinite times (making the fifth point N of a composite curve coincide with the eighth point L of the subsequent composite curve), gives rise to the rack profile p.

Figure 5A:
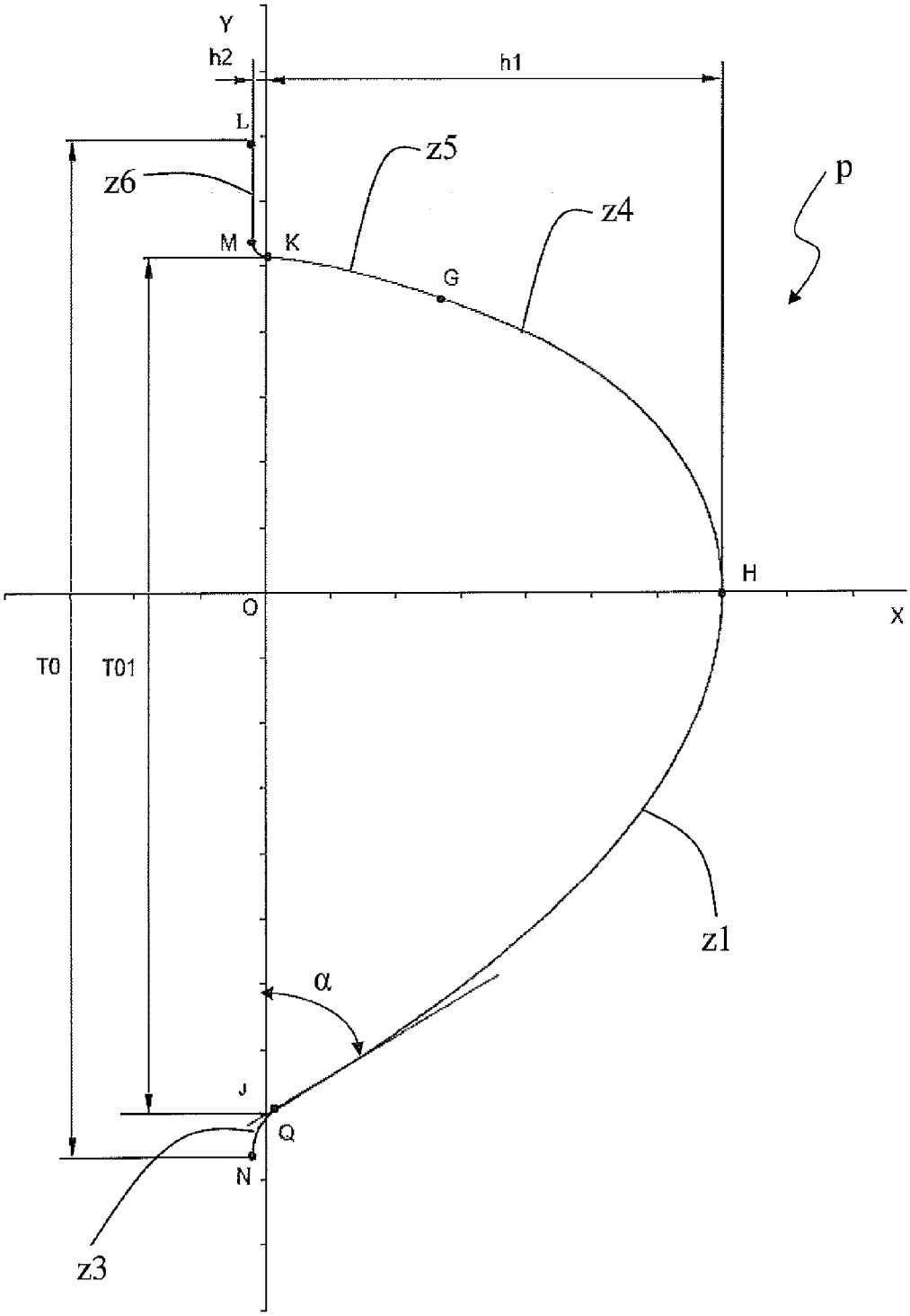
FIG. 5*a* illustrates the graph of a second embodiment of a rack profile used to construct the compressor of FIG. 1.
Figure 5B:
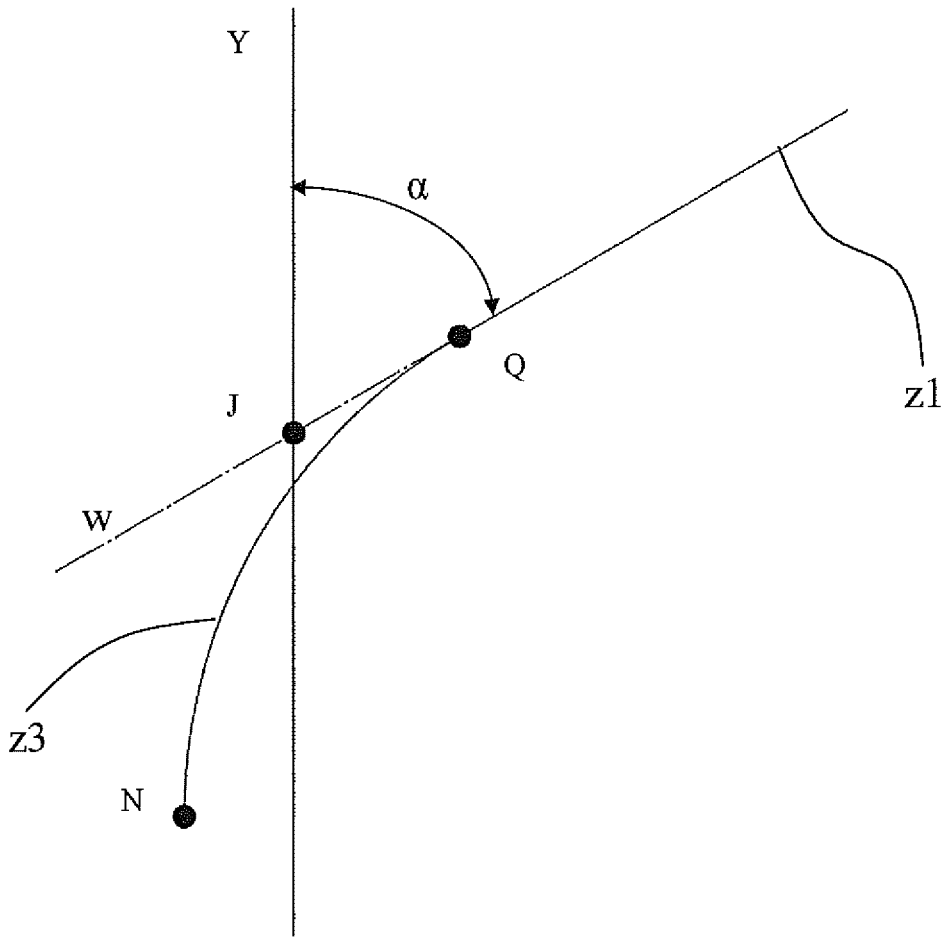
FIG. 5*b* illustrates an enlarged view of a portion of the rack profile of FIG. 5*a;*

In a second embodiment, illustrated in FIG. 5*a*, the rack profile p comprises, in addition to the first curve z1, a third curve z3, a fourth curve z4, a fifth curve z5 and a sixth curve z6.

The third curve z3, in this second embodiment, consists of an arc extending between said second point Q and the fifth point N. The measure of the radius of the third curve z3 is such that the tangent to said third curve z3 in the fifth point N is parallel to the axis of ordinates Y.

The third curve z3 and the first curve z1 have in the second point Q a same tangent line w (see FIG. 5*b*) incident to the axis of ordinates Y in the fourth point J in such a manner as to form a main acute angle a with the axis of ordinates Y. Preferably, said main acute angle α has a value between 10° and 50°. The fourth curve z4, the fifth curve z5 and the sixth curve z6 of the second embodiment of the rack profile p are identical, respectively, to the fourth curve z4, the fifth curve z5 and the sixth curve z6 of the first embodiment of the rack profile p.

With the Cartesian reference system (X, Y) chosen, the first curve z1 and the second curve z2 lie in the fourth quadrant of the Cartesian reference frame (X, Y). The third curve z3, in both embodiments (FIG. 4 and FIG. 5), lies partially in the third and partially in the fourth quadrant of the Cartesian reference frame (X, Y). The fourth curve z4 lies in the first quadrant of the Cartesian reference frame (X, Y). The fifth curve z5 lies partially in the first and partially in the second quadrant of the Cartesian reference frame (X, Y). The sixth curve z6 lies in the second quadrant of the Cartesian reference frame (X, Y). In particular, the projection of the rack profile p on the axis of abscissa X has a dimension given by the sum of the addendum h1 of the male rotor 2 and the addendum h2 of the female rotor 3. The projection of the rack profile p on the axis of ordinates Y has a dimension given by the sum of the first thickness T01 of the lobe 4 of the male rotor 2 and the second thickness T02 of the lobe 7 of the female rotor 3 (the sum is indicated with T0 in FIG. 5*a*).

The functioning of the screw compressor according to the present invention is described hereunder.

The profiles of the two rotors 2, 3 are generated by the method of enveloping the rack profile p.

The profile of the male rotor 2 is generated by enveloping the positions assumed by the rack profile p when the polar (i.e. the axis of ordinates Y) of the rack profile p rolls without sliding on the polar (i.e. on the pitch circumference Cp1) of the male rotor 2. The profile of the female rotor 3 is generated by enveloping the positions assumed by the rack profile p when the polar (i.e. the axis of ordinates Y) of the rack profile p rolls without sliding on the polar (i.e. on the pitch circumference Cp2) of the female rotor 3.

Once the rotors 2, 3 have been constructed, they are made to rotate around respective axes. In particular, the male rotor 2 rotates around the first rotation axis O1 whereas the female rotor 3 rotates around the second rotation axis O2. During rotation, the screw-shaped ribs of the male rotor 2 mesh with the screw-shaped grooves of the female rotor 3 and vice-versa.

Figure 7:
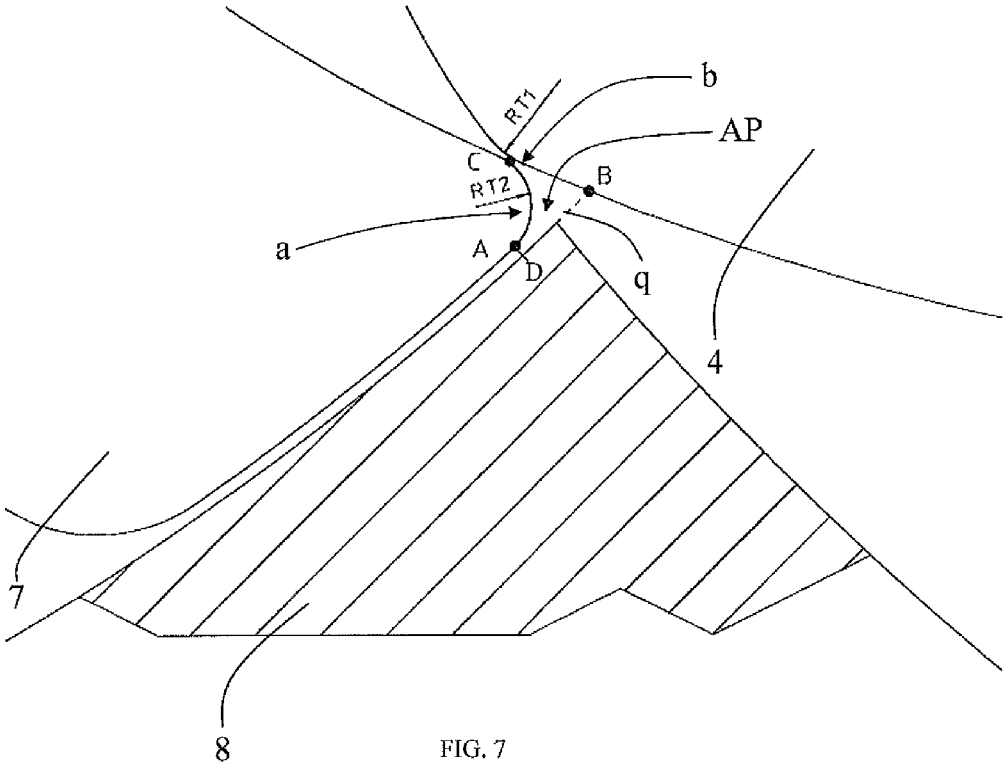
FIG. 7 illustrates the blow hole area of the screw compressor of FIG. 1, in a closer configuration, in cross section.

FIG. 7 illustrates the position of the rotors 2, 3 when they start meshing, in which the casing body 8, the female rotor 3 and the male rotor 2 are in a configuration of closest proximity to one another. The letter A indicates a first point of the female rotor 3 set at a smaller distance from the casing body 8. In particular, said first point A is at a smaller distance from a first side 1 of the casing body 8 (considering the compressor 1 in cross section). Let the extension of said first side 1 of the casing body 8 be called q; it intersects the male rotor 2 in a second point B. The letter C indicates a third point of the female rotor 3 set at a smaller distance from the male rotor 2 (at least, said third point C is the point of contact between the two rotors 2, 3). The letter D indicates a fourth point D, obtained by projecting the first point A on the first side l of the casing body 8. The blow hole area AP is defined as the area delimited by the first point A, the fourth point D, the second point B and the third point C and lying between the female rotor 3, the male rotor 2, the first side l of the casing body 8 and said extension q passing through the second point B. It should be noted that the third point C is in fact the point of contact between the two rotors 2, 3 in the case of an oil-flooded screw compressor 1. In the case of a dry screw compressor 1, in the third point C there is no contact between the two rotors 2, 3.

The characteristics of the screw compressor according to the present invention emerge clearly from the description provided, as do the advantages thereof.

In particular, thanks to the fact that the first curve has the above-described morphology, it is possible to achieve very high values for the addendum of the male rotor and for the thickness of the lobe of the male rotor. In fact, as is well known, in order to maximise the volume generated by the profiles of the rotors, it is necessary to maximise the area between the rack profile and its polar. The addendum and the thickness of the lobe of the male rotor are the parameters which have the greatest influence in the calculation of said area, and have thus been maximised compatibly with the choice of a first curve (hyperbola) that serves to avoid problems in the construction and conjugation of the rotor profiles.

The maximisation of the addendum and of the thickness of the lobe of the male rotor are made possible by the choice of intervals of variability for the first parameter defining the hyperbola and for the main acute angle. Such choices also enable the relation between the thicknesses of the lobes of the rotors to be optimised, thus reducing the wear on the tools used to cut the rotor profiles. Accordingly, both the interval of time between one sharpening and another and the life of said tools are lengthened, significantly contributing to a reduction in overall costs.

Furthermore, thanks to the pre-selected factors of proportionality between the length of the radius of the first arc and the length of the radius of the second arc, the reduction in the blow hole area has been optimised, thus maximising the volumetric efficiency of the compressor.

Moreover, thanks to the configuration of the fourth and fifth curves, the dimension of the gas pockets that are created between the sides of smaller extent of the male rotor and of the female rotor during the meshing thereof is minimised. This choice contributes to maximising the volumetric efficiency of the screw compressor proposed.

The invention claimed is:

1. A screw compressor (1) comprising at least a male rotor (2) and at least a female rotor (3) rotating respectively around a first axis (O1) and second axis (O2) of rotation, said male rotor (2) showing, in cross section, lobes (4) and valleys (6) meshing with corresponding valleys (5) and lobes (7) of the female rotor (3), said lobes (4) of the male rotor (2) and said valleys (5) of the female rotor (3) having profiles at least partially generated by enveloping a rack profile (p), wherein said profiles of the lobes (4) of the male rotor (2) and of the valleys (5) of the female rotor (3) have portions generated by enveloping a first curve (z1) of the rack profile (p), said first curve (z1) extending, in a Cartesian reference frame (X, Y), between a first point (H) and a second point (Q) and having a convexity in the positive direction of the axis of abscissa (X), said first point (H) lying on the axis of abscissa (X) at a distance from an origin (O) of the Cartesian reference frame (X, Y) equal to an addendum (h1) of the male rotor (2), and wherein said first curve (z1) is a branch of hyperbola in which a generic point has coordinates (XS, YS) defined by the following equations:

$$XS=(h1+RA)-RA/\cos\phi$$

$$YS=-HB\ tg\ \phi,$$

said equations being parametric and dependant upon a first parameter (RA), a second parameter (HB) and a third parameter (ϕ), said first parameter (RA) being the measure of a radius of an auxiliary circumference (u) tangent to the rack profile (p) in said first point (H) and having its centre (C) lying upon the axis of abscissa (X), said second parameter (HB) being the distance from the centre (C) of the auxiliary circumference (u) of an auxiliary line (r) parallel to the axis of ordinates (Y) and passing through the axis of abscissa (X) between said first point (H) and said centre (C) of the auxiliary circumference (u), said third parameter (ϕ) indicating an auxiliary acute angle delimited by the axis of abscissa (X) and by a radius of said auxiliary circumference (u) passing through an auxiliary point (T) lying on said auxiliary line (r) and having an ordinate (YT) equal to the ordinate (YS) of said generic point (S) lying on said branch of hyperbola.

2. The screw compressor (1) according to claim 1, wherein said first parameter (RA) varies between a minimum value equal to the distance (I) between said first axis (O1) and said second axis (O2) of rotation of the rotors (2, 3) and a maximum value equal to fifty times the distance (I) between said axes (O1, O2) of rotation of the rotors (2, 3).

3. The screw compressor (1) according to claim 1, wherein said rack profile (p) further comprises a second curve (z2) consisting of a rectilinear segment extending between said second point (Q) and a third point (P), said second curve (z2) being tangent to the first curve (z1) in said second point (Q) and having an extension incident to the axis of the ordinates (Y) in a fourth point (J) such as to form a main acute angle (α) with said axis of ordinates (Y).

4. The screw compressor (1) according to claim 3, wherein said rack profile (p) further comprises a third curve (z3) consisting of an arc extending between said third point (P) and a fifth point (N), said third curve (z3) being tangent to the second curve (z2) in said third point (P).

5. The s crew c compressor (1) according to claim 3, wherein said rack profile (p) further comprises a fourth curve (z4) consisting of a trochoid extending between said first point (H) and a sixth point (G), said fourth curve (z4) being tangent to the first curve (z1) in said first point (H) and generating, by enveloping the male rotor (2), a second arc (b) joining two sides (FA1, FS1) of said male rotor (2).

6. The screw compressor (1) according to claim 5, wherein said rack profile (p) further comprises a fifth curve (z5) extending between said sixth point (G) and a seventh point (M) having a distance from the axis of ordinates (Y) equal to an addendum (h2) of the female rotor (3), said fifth curve (z5) being tangent to the fourth curve (z4) in said sixth point (G) and generating, by enveloping the female rotor (3), a first arc (a).

7. The screw compressor (1) according to claim 6, wherein said rack profile (p) further comprises a sixth curve (z6) consisting of a rectilinear segment parallel to the axis of ordinates (Y) and extending between said seventh point (M) and an eighth point (L) situated at a distance from the fifth point (N) equal to the sum of a first thickness (T01) of the lobes (4) of the male rotor (2) and a second thickness (T02) of the lobes (7) of the female rotor (3).

8. The screw compressor (1) according to claim 3, wherein said main acute angle ($\alpha$) has a value between 10° and 50°.

9. The screw compressor (1) according to claim 1, wherein said rack profile (p) further comprises a third curve (z3) consisting of an arc extending between said second point (Q) and a fifth point (N), said third curve (z3) and said first curve (z1) having in said second point (Q) a same tangent line (w) incident to the axis of ordinates (Y) in a fourth point (J) in such a manner as to form a main acute angle ($\alpha$) with said axis of ordinates (Y).

10. Screw compressor (1) comprising at least a male rotor (2) and at least a female rotor (3) rotating respectively around a first axis (O1) and second axis (O2) of rotation, said male rotor (2) showing, in cross section, lobes (4) and valleys (6) meshing with corresponding valleys (5) and lobes (7) of the female rotor (3), said lobes (4) of the male rotor (2) and said valleys (5) of the female rotor (3) having profiles generated, at least partially,-by enveloping a rack profile (p), wherein said profiles of the lobes (4) of the male rotor (2) and of the valleys (5) of the female rotor (3) have portions generated by enveloping a first curve (z1) of the rack profile (p), said first curve (z1) extending, in a Cartesian reference frame (X, Y), between a first point (H) and a second point (Q) and having a convexity in the positive direction of the axis of abscissa (X), said first point (H) lying on the axis of abscissa (X) at a distance from an origin (O) of the Cartesian reference frame (X, Y) equal to an addendum (h1) of the male rotor (2), and wherein each of said valleys (5) of the female rotor (3) has at least a side (FS2) joined with the consecutive lobe (7) of the female rotor (3) by means of a first arc (a) having a radius of a predefined length (RT2) varying between a minimum value equal to the addendum (h2) of the female rotor (3) multiplied by 1.1 and a maximum value equal to the addendum (h2) of the female rotor (3) multiplied by 1.5.

11. The screw compressor (1) according to claim 10, wherein each of said lobes (4) of the male rotor (2) has two sides (FA1, FS1) joined by means of a second arc (b) having a radius of a predefined length (RT1) varying between a minimum value equal to double the predefined length (RT2) of the radius of said first arc (a) and a maximum value equal to the predefined length (RT2) of the radius of said first arc (a) multiplied by 2.5.

* * * * *